US005286089A

United States Patent [19]

Goldman

[11] Patent Number: 5,286,089

[45] Date of Patent: Feb. 15, 1994

[54] SEAT CUSHION FOR ALLEVIATION OF PERINEAL AND RECTAL DISCOMFORT

[76] Inventor: Stephen L. Goldman, 4821 Beach Dr. SW., Seattle, Wash. 98116

[21] Appl. No.: 840,008

[22] Filed: Feb. 21, 1992

Related U.S. Application Data

[63] Continuation-in-part of Ser. No. 660,534, Feb. 25, 1991, abandoned.

[51] Int. Cl.[5] ..... A47C 7/18

[52] U.S. Cl. ..... 297/452.26; 297/452.23; 297/DIG. 1

[58] Field of Search ..... 297/459, 201, 214, 195, 297/DIG. 1, 452, 458, 188; 5/653, 448, 464

[56] References Cited

U.S. PATENT DOCUMENTS

| | | | |
|---|---|---|---|
| 718,850 | 1/1903 | Kruseman . | |
| 1,538,542 | 5/1925 | Blake . | |
| 1,934,918 | 11/1933 | Everson | 27/1 |
| 2,156,629 | 5/1939 | Hutchison | 297/459 |
| 2,412,112 | 12/1946 | Wood et al. | 155/184 |
| 2,855,986 | 10/1958 | Engelen, Sr. | 155/182 |
| 3,112,956 | 12/1963 | Schick et al. | 297/219 |
| 3,276,047 | 10/1966 | Emery | 5/349 |
| 3,749,442 | 7/1973 | Berg et al. | 297/458 X |
| 3,939,508 | 2/1976 | Hall et al. | 5/345 |
| 4,039,363 | 8/1977 | Robertson | 297/DIG. 1 X |
| 4,189,182 | 2/1980 | Rhoe | 297/460 |
| 4,218,090 | 8/1980 | Hoffacker et al. | 297/214 |
| 4,255,824 | 3/1981 | Pertchik | 5/441 |
| 4,354,677 | 10/1982 | Young | 272/144 |
| 4,471,993 | 9/1984 | Watson | 297/460 X |
| 4,643,481 | 2/1987 | Saloff et al. | 297/458 |
| 4,819,288 | 4/1989 | Lowthian | 297/458 X |
| 4,824,174 | 4/1989 | Dunn, Sr. | 297/453 |
| 4,951,334 | 8/1990 | Maier | 297/459 X |

*Primary Examiner*—Peter R. Brown
*Assistant Examiner*—Milton Nelson, Jr.
*Attorney, Agent, or Firm*—Christensen, O'Connor, Johnson & Kindness

[57] ABSTRACT

Disclosed is a unitary foam seat cushion (10) that is configured and arranged to eliminate contact pressure on the rectal, perineal and genital regions of a person seated on the seat cushion without subjecting the perineal region to substantial stress or tension. The seat cushion includes a base (12) and two upwardly projecting elongate support members (16 and 18). The support members are of an arcuate (upwardly extending convex) cross-sectional geometry and are positioned in parallel spaced apart relationship for support of the ischia and thighs. Located between the support members is a channel (14) that extends downwardly into the seat cushion to form a void that prevents exertion of contact pressure on the rectal, perineal and genital areas. The portions (30 and 32) of the support members nearest the knees of a seated person taper downwardly for improved weight distribution and comfort of a person seated on the seat cushion.

20 Claims, 4 Drawing Sheets

SEAT CUSHION FOR ALLEVIATION OF PERINEAL AND RECTAL DISCOMFORT

CROSS-REFERENCE TO RELATED PATENT APPLICATION

This application is a continuation-in-part of U.S. Pat. application Ser. No. 07/660,534 filed Feb. 25, 1991 now abandoned, the benefit of the filing date of which is hereby claimed under 35 U.S.C. §120.

FIELD OF THE INVENTION

This invention relates to seat cushions and, more particularly, to a seat cushion that allows persons having discomfort in the perineal area of the body to sit more comfortably.

BACKGROUND OF THE INVENTION

Pain and discomfort of the rectal and perineal body regions stem from a number of causes such as hemorrhoids, rectal surgery or an episiotomy. Persons experiencing rectal or perineal pain or discomfort often seat themselves on a donut-shaped cushion to prevent contact with and pressure on the affected area. Although relatively inexpensive, donut-shaped cushions do not provide a desired degree of relief. For example, in many cases donut-shaped cushions result in tension being exerted on the perineal region. Such tension can cause increased discomfort, especially when surgical sutures are present.

Sufferers of perineal region discomfort also have used various types of wheelchair cushions and sporting event cushions in attempting to sit without increased pain or discomfort. However, such cushions are not designed for alleviation of both pressure and tension on the perineal region and, thus, provide little or no benefit. Further, wheelchair cushions that may provide some degree of relief often are disadvantageous from the standpoint of relatively high cost, especially for surgical patients and others who experience discomfort for a period of a few days or, at most, a few weeks.

SUMMARY OF THE INVENTION

This invention provides an inexpensive, disposable, compressible seat cushion for eliminating contact pressure on the perineal region without subjecting the region to substantial stress or tension. The upper surface of the seat cushion is configured to define a pair of elongate parallel support members that support the ischia and thighs and a channel that is located between the pair of parallel support members. The parallel support members and channel extend from the front edge to the back edge of the seat cushion. Each support member includes a first support surface that lies parallel to the bottom surface of the seat cushion and extends from the back edge of the seat cushion to a taper point, and a second support surface that tapers downwardly from the taper point toward the bottom surface, ending at the front edge of the seat cushion. The second support surface allows a seated person to distribute his or her weight from the thigh and ischium areas to the legs and feet, allowing the person to sit more comfortably.

In one disclosed embodiment, the seat cushion is constructed of an expanded polyurethane foam. Each support member is of substantially tubular geometry, having an arcuate upper surface. The channel extends downwardly into the upper surface of the cushion to ensure that no contact pressure is exerted on the perineal region. If desired, the seat cushion can include a moisture-impervious cover such as a surface layer or skin of high density polyurethane foam or other material.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
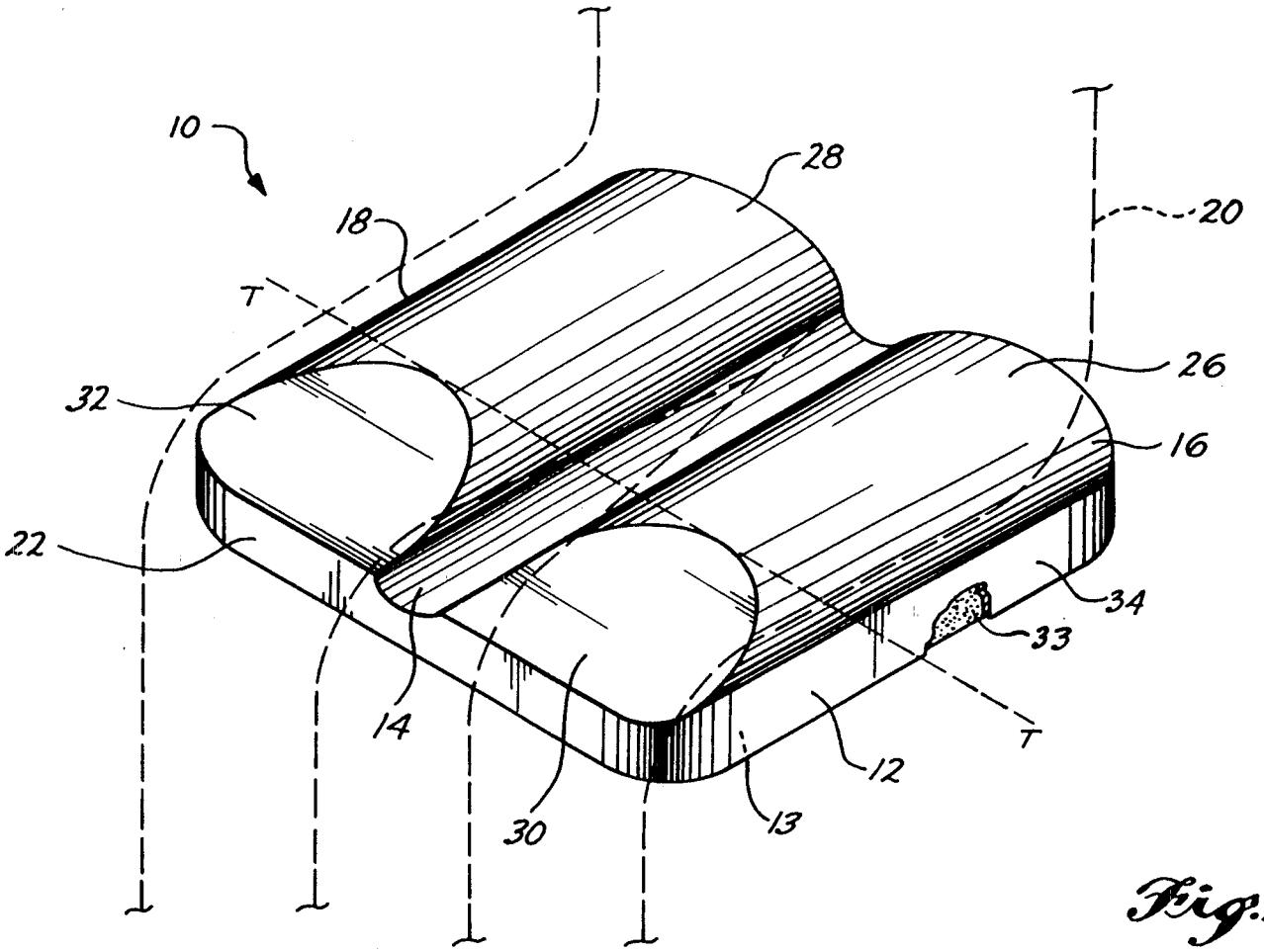
FIG. 1 is a perspective view of a first exemplary embodiment of a seat cushion that is constructed in accordance with this invention, with the outline of a seated person being shown in phantom.
Figure 3:
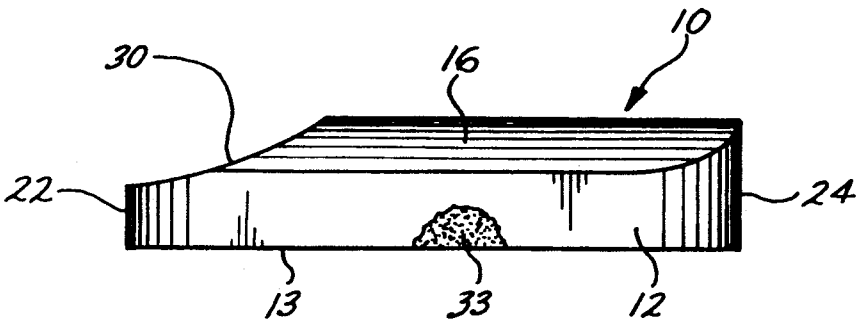
FIG. 3 is a side elevation view of the seat cushion shown in FIG. 1.
Figure 2:
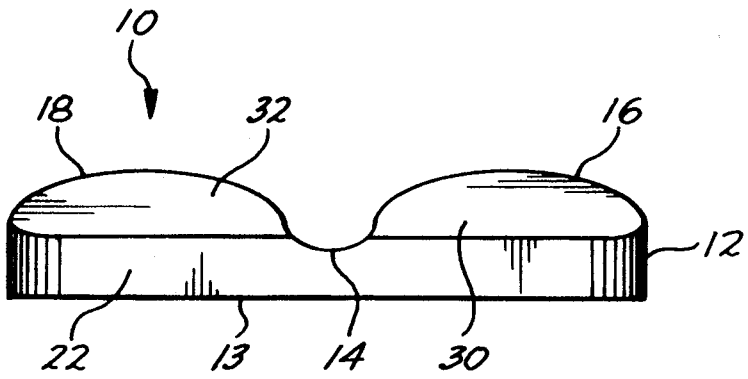
FIG. 2 is a front elevation view of the seat cushion depicted in FIG. 1.

Seat cushion 10, shown in FIGS. 1–3, is a compressible, unitary seat cushion which includes a base 12, a channel 14, and support members 16 and 18. A seated person, illustrating use of the seat cushion 10, is shown in phantom in FIG. 1.

Base 12 of the depicted embodiment is of substantially rectangular geometry having a relatively flat bottom surface 13 that allows seat cushion 10 to be easily placed on a seating surface such as a chair, a sofa or a car seat. Channel 14 extends downwardly into base 12 to provide a void that prevents or at least minimizes contact between seat cushion 10 and the rectal, perineal and genital regions of a person seated on the seat cushion. In the depicted arrangement, channel 14 is substantially U-shaped in geometry, extending from the front 22 to the back 24 of base 12.

The support members 16 and 18 project upwardly from the base 12 to form elongate regions of seat cushion 10 that are spaced apart from one another by channel 14. As can be seen in FIG. 1, each support member 16 and 18 of the currently preferred embodiments of the invention extends between the front 22 and back 24 of base 12 with the support members being of arcuate (convex) cross-sectional geometry. As also is shown in FIG. 1, the spacing between the uppermost portion of support members 16 and 18 is established to correspond to the position of the ischia and thighs of a person seated on seat cushion 10. Configured and arranged in this manner, seat cushion 10 provides firm support for the upper leg and buttock regions that prevents exertion of contact pressure on the rectal, perineal and genital areas by the surface of channel 14. Moreover, the arrangement supports a seated person without exerting substantial lateral forces on the buttocks which could cause tension to be exerted on these body regions.

To provide additional comfort, the forward end of each support member 16 and 18 is tapered downwardly beginning at a taper point indicated by line TT of FIG. 1 and extending toward base 12. The tapered regions, (30 and 32 in FIGS. 1-3), allow a person seated on seat cushion 10 to redistribute his or her weight from the thigh and ischium areas to the legs and feet. Thus, a person seated on seat cushion 10 can assume a posture of maximum comfort and can periodically vary his or her position to maintain maximum comfort during extended periods in which he or she remains seated. As can be seen in FIG. 1, the tapered regions 30 and 32 extend from a taper point generally designated by line TT to the front 22 of the seat cushion.

In the practice of the invention, various materials and methods of construction can be employed to produce a seat cushion 10 that exhibits the desired compressible and resilient qualities. Regardless of the material employed, it can be noted that the thickness of the seat cushion 10 is inversely related to the compressibility of the material being used and, in addition, is directly related to the weight of the person to be supported by the cushion. Thus, in constructing an embodiment of the invention for use by a person whose weight is known or is within a specified weight range, the overall thickness of seat cushion 10 will be determined by the compressibility of the material being used, with greater thickness being required for materials that are more easily compressed. One material suitable for use in constructing seat cushion 10 is open-cell foam. The compressibility of an open-cell foam material is based on two variables: the density of the foam and its firmness. The firmness of an open-cell foam can be measured by an industry standard called the index load deflection (ILD) standard. An ILD measurement is the amount of pressure required, in pounds, to depress a 12" square, 4" high cube of open-cell foam to 75% of its height, i.e., to three inches.

Currently preferred embodiments of the invention are formed of a polyurethane foam 33 by injecting a liquid polyurethane component mixture and any necessary foaming agent into a mold cavity that is configured and corresponds with the shape and size of seat cushion 10. In addition, the foam preferably has a density on the order of 2 lbs. per cubic foot and a firmness on the order of 60 lbs. ILD. It has been found that a seat cushion 10 constructed with material having these characteristics is suitable for use on a wide variety of seating surfaces and by a large percentage of the adult population. Molding processes for achieving polyurethane foam that exhibits these density and firmness characteristics are well known in the art.

To permit placement on a wide variety of seating surfaces, the currently preferred embodiments have a length on the order of 36 centimeters and a width of approximately 41 centimeters, with the length of seat cushion 10 being taken in the direction that corresponds to the axial center line of channel 14. The thickness of base 12 (i.e., the distance between bottom surface 13 and the lower outer edges of support members 16 and 18) is approximately five centimeters with the distance between lower surface 13 and the uppermost portion of support members 16 and 18 being approximately 8 centimeters. Channel 14 of these currently preferred embodiments of the invention extends downwardly into base 12 approximately 2.5 centimeters. Tapered regions 30 and 32 extend rearwardly from front 22 of base 12 for a distance of approximately 15 centimeters with the distance between bottom surface 13 of base 12 and the forward end of each tapered region 30 and 32 being on the order of 5 centimeters.

Although seat cushions constructed in accordance with this invention can be covered with a removable washable slipcover, the invention can employ an integral protective coating 34. For example, conventional polyurethane foam molding techniques can be employed to form a moisture impervious surface layer over the entire surface of the seat cushion 10. Alternatively, the upper surface regions or the entire surface of the seat cushion can be coated with a moisture impervious material by dipping, spraying or other conventional techniques.

Figure 4:
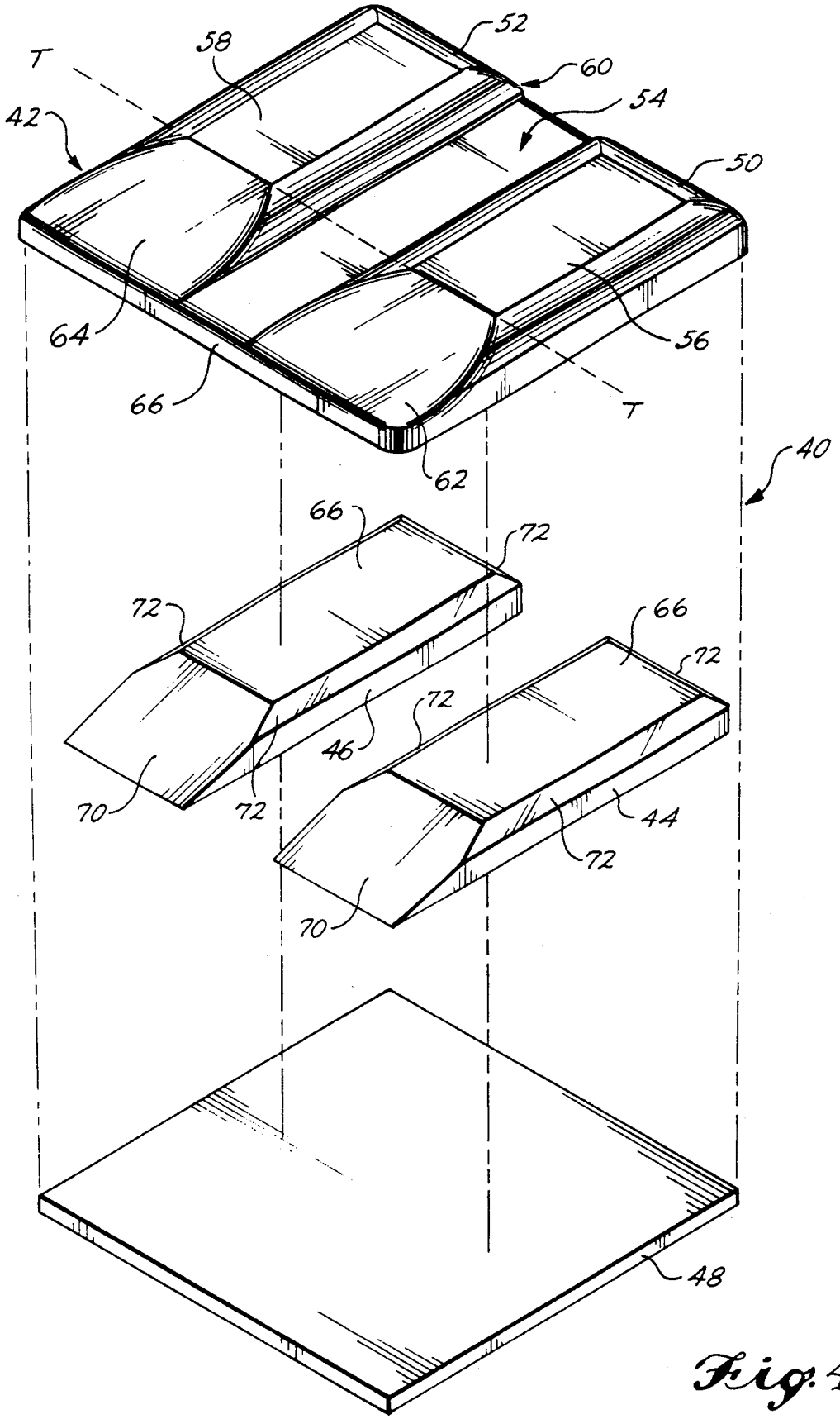
FIG. 4 is an exploded view of a second exemplary embodiment of a seat cushion that is constructed in accordance with the invention.
Figure 5:
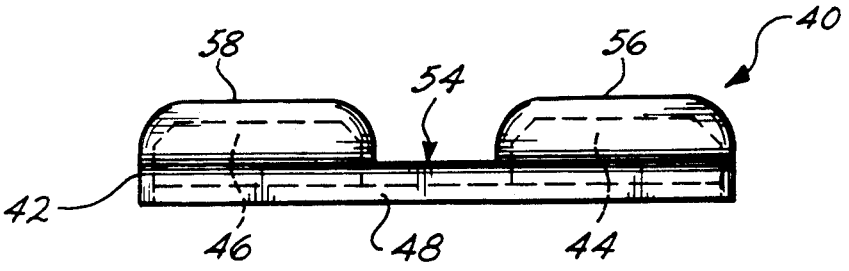
FIG. 5 is a front elevation view of the seat cushion depicted in FIG. 4.
Figure 6:
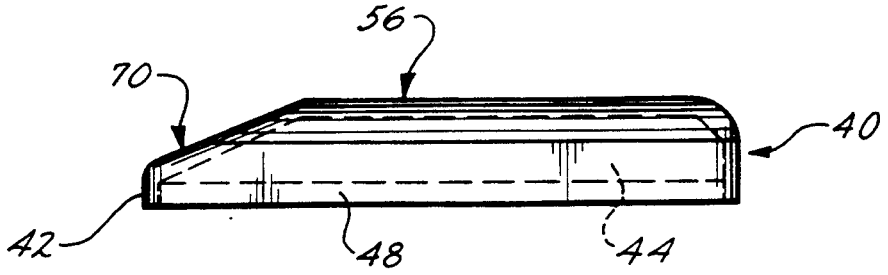
FIG. 6 is a side elevation view of the seat cushion depicted in FIG. 4.

FIGS. 4-6 illustrate a second exemplary embodiment of a seat cushion 40 formed in accordance with the invention. Seat cushion 40 comprises four separate components, including a shell 42, backfill sections 44 and 46 and a base 48. The shell 42 defines an upper seating surface of the seat cushion, and includes two elongate, spaced-apart support members 50 and 52 that support the legs and buttocks of a seated person. The backfill sections 44 and 46 provide a buttress underneath the support members 50 and 52, thereby aiding in support of a seated person. The shell 42 also includes a channel 54 between the support members 50 and 52, that prevents, or at least minimizes, contact between the seat cushion and the rectal, perineal and genital areas of the person. The base 48 encloses the backfill sections within the shell, thereby forming an integral seat cushion.

Addressing the components of seat cushion 40 in greater detail, the shell 42 is formed from a piece of relatively thin material into the configuration shown in FIG. 4. Thus, the area beneath the upper surface of the shell is a cavity that has the relative configuration of the upper surface. With reference to the upper seating surface, each support member 50 and 52 includes a substantially flat support surface 56 and 58 for supporting the ischia and thighs of a seated person. The support surfaces 56 and 58 lie parallel to one another and extend from the back edge 60 of the shell to a taper point, generally designated by line TT in FIG. 4. As can be seen, the sides of the support members adjacent support surfaces 56 and 58 are generally arcuate, curving downwardly toward the base 48. Each support member 50 and 52 further includes a sloped or tapered support surface 62 and 64 that tapers downwardly from line TT, toward the base 48, ending at the front edge 66 of the shell 42. As is stated above, the tapered support surfaces allow a seated person to redistribute his or her weight from the thigh and ischium areas to the legs and feet. By removing pressure from the lower thigh, the seated person can sit more comfortably. If the length of the support members are defined as L, the taper points (line TT) are located a distance lying somewhere between $\frac{1}{8}$L and $\frac{7}{8}$L measured from the front 66 of the seat cushion 40.

The channel 54 has a substantially flat middle surface and side surfaces that are defined by the arcuate-shaped sides of the support members. The channel extends the entire length of the seat cushion 40, adjacent the support members. The width of the channel is dimensioned to minimize or prevent contact with the genital, perineal and rectal areas of a seated person. Configured and arranged in this manner, the support members and channel work in conjunction to provide firm support for the upper leg and buttock regions while preventing or at least minimizing pressure, normally associated with seating, around the genital, perineal and rectal areas.

The arrangement also supports a seated person without exerting substantial lateral forces on the buttocks, which could cause tension to be exerted on these body regions. It is important to note that because channel 54 extends the entire length of the seat cushion, a person can sit on the seat cushion without being concerned about whether the person is positioned either too far ahead or behind the seat cushion. In contrast, if the channel were to extend only partially along the support members, care would have to be exercised when sitting to ensure affected portions do not come in contact with the seat cushion itself.

The backfill sections 44 and 46 are generally dimensioned in the shape of the support members 50 and 52 of the shell 42 and abut the lower surface (cavity) of the shell when placed therein. In that regard, the backfill sections 44 and 46 are elongate and substantially identical sections, with each section including a flat surface 68, a tapered surface 70, and a pair of beveled surfaces 72. The beveled surfaces 72 are located along the length of the flat surface 68, on each side thereof, and also along the back side of the backfill sections. It is noted that while the configuration of the backfill sections is not identical to that of the support members, the backfill sections sufficiently match the inner cavity to allow a proper fit. The backfill sections are configured in the manner shown in FIG. 4 out of manufacturing convenience.

The base 48 is generally rectangular and is dimensioned to fit inside the walls of the shell 42. In the preferred construction of the invention, the backfill sections are adhesively bonded to the lower surface of the shell, directly beneath the support members. The base is then adhesively bonded to the lower surface of the shell, beneath the channel 54, and to the inner walls of the shell, i.e., opposite the front edge 66, back edge 60, and side edges.

In the practice of the invention, various materials and methods of construction can be employed to produce a seat cushion that exhibits the desired compressible and resilient qualities. As is noted above with respect to seat cushion 10 of FIG. 1, the thickness of the seat cushion 40 is inversely related to the compressibility of the material being used and, in addition, is directly related to the weight of the person to be supported by the cushion.

One suitable material for constructing seat cushion 40 is closed-cell foam. The components of seat cushion 40 are ppreferalby constructed of a ethyl vinyl acetate (EVA) closed-cell foam having density on the order of 4½ lbs. per cubic foot for the shell 42 and base 48, and 2 lbs. per cubic foot for the backfill sections 44 and 46. The seat cushion 40 constructed in this matter is generally moisture impervious, and thus a slip cover or other means of protecting the cushion is not needed.

Currently, preferred embodiments of the seat cushion 40 are formed using a thermal forming device for forming foam sheets to desired configurations, e.g., by using a mold that has been tooled to the desired configuration. Such devices are generally known in the art. To this end, a mold is constructed that has an inner cavity configured and corresponding to the shape of the shell 42. After the mold has been tailored, an exemplary method of forming the seat cushion 40 includes: (1) placing a sheet of closed-cell foam having a desired shell thickness onto the mold; (2) heating the mold/sheet to a pre-determined temperature such that it acquires the configuration of the mold; (3) cutting the newly-formed shell from the remaining foam sheet; (4) cutting the backfill sections 44 and 46 from a block of closed-cell foam; (5) cutting the base 48 from a sheet of foam having a desired thickness; and (6) adhesively bonding the backfill sections and base to the shell.

Currently preferred embodiments of seat cushion 40 have a substantially square base, with sides on the order of 36 centimeters. The height of the flat support surfaces 56 and 58 is on the order of 5 centimeters. The height of the edges of the shell is approximately two centimeters, which also corresponds to the height of the channel 54. The width of the channel is preferably on the order of 9 centimeters. The tapered regions 62 and 64 extend rearwardly from front edge 66 of shell 42 for a distance of approximately 10 centimeters.

It should be recognized by those skilled in the art that various modifications and changes can be made in the disclosed embodiments of the invention without departing from the scope and the spirit of the invention. As previously noted, the seat cushion of this invention can be constructed of various materials other than the polyurethane foam of the currently preferred embodiments. For example, the seat cushion can be constructed of vinyl or other suitable sheet material to define one or more chambers that are filled or inflated with air, another gas, or a fluid. Conventional techniques can be used to construct a seat cushion of these materials.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A compressible and resilient seat cushion for alleviating the perineal and rectal discomfort of a person with hemorrhoids, rectal surgery episiotomy, or the like, said seat cushion comprising a front edge, a back edge, a substantially rectangular bottom surface and a top seating surface, the seating surface including a pair of elongate, upwardly projecting support members extending parallel to one another and a channel located between the pair of parallel support members, the parallel support members and channel extending from the front edge to the back edge of the seat cushion, each support member including a base and a first support surface that lies parallel to the bottom surface and extends from the back edge of the seat cushion to a taper point and a second support surface that tapers downwardly from the taper point toward the bottom surface, ending at the front edge of the seat cushion, the bases of the support members being of substantially constant width along their length and spaced apart from one another by a distance that positions the support members for approximate registration with the thighs and ischia of a person seated on the seat cushion.

2. The seat cushion of claim 1, wherein the length of each support member is designated as L and wherein the taper point of each support member is located a distance somewhere between ⅛L and ⅞L, measured from the front edge of the seat cushion.

3. The seat cushion of claim 1, wherein the first support surface of each support member is substantially flat.

4. The seat cushion of claim 1, wherein the first support surface of each support member is of arcuate cross-sectional geometry.

5. The seat cushion of claim 1, wherein the channel extends downwardly toward the bottom surface and into the seat cushion a distance sufficient for the prevention of substantial contact pressure on the perineal region of a person seated on the seat cushion.

6. The seat cushion of claim 1, wherein the width of the channel is 9 centimeters.

7. The seat cushion of claim 1, further including a moisture impervious surface layer extending over at least the surfaces of the parallel support members and the channel.

8. The seat cushion of claim 1, wherein the cushion is constructed of a foam material.

9. The seat cushion of claim 8, wherein the foam material is a polyurethane foam.

10. The seat cushion of claim 9, wherein the polyurethane foam material has density on the order of 2 lbs. per cubic foot and an index load deflection on the order of 60 lbs.

11. A seat cushion for relieving tension and stress normally associated with sitting from the rectal region of a person, the seat cushion formed of compressible resilient foam material and including a front edge, a back edge, a substantially rectangular bottom surface and a top seating surface, the seating surface having first and second spaced-apart, elongate support members that project upwardly for supporting the ischia and thighs of a person, the first and second elongate support members being substantially parallel to one another, each support member including a base of substantially constant width along the length of the support member and including a sloped surface that extends from the front edge of the seat cushion rearwardly and upwardly until reaching a predetermined level above the bottom surface of the seat cushion, each support member including a first support surface thereafter extending to the back edge of the seat cushion remaining at said predetermined level, the seat cushion further including a channel located between the first and second support members that extends between the front and back edges of the seat cushion.

12. The seat cushion of claim 11, wherein the predetermined level is 5 centimeters.

13. The seat cushion of claim 11, wherein the compressible resilient foam material is a polyurethane foam.

14. The seat cushion of claim 11, wherein the width of the channel is 9 centimeters.

15. The seat cushion of claim 11, wherein the first support surface of each support member is substantially flat.

16. The seat cushion of claim 11, wherein the first support surface of each support member is of arcuate cross-sectional geometry.

17. A compressible and resilient seat cushion, comprising:

(a) a shell having a front edge, a back edge, a substantially rectangular open bottom and a top seating surface, the seating surface including a pair of elongate, upwardly projecting support members extending parallel to one another and a channel located between the pair of parallel support members, the parallel support members and channel extending from the front edge to the back edge of the shell, each support member including a first support surface that extends from the back edge of the seat cushion to a taper point and a second support surface that tapers downwardly from the taper point toward the bottom surface, ending at the front edge of the seat cushion, the support members including bases of substantially constant width along their length and spaced apart from one another by a distance that positions the support members for approximate registration with the thighs and ischia of a person seated on the seat cushion;

(b) buttress means for supporting the parallel support members, the buttress means being attached to the bottom surface of the shell, beneath each parallel support member; and (c) a base coupled to the open bottom of the shell for enclosing the buttress means within the shell.

18. The seat cushion of claim 17, wherein the shell is comprised of closed-cell foam having a density on the order of 4½ lbs per cubic foot.

19. The seat cushion of claim 17, wherein the buttress means includes a pair of backfill sections, each backfill section having an upper surface configured substantially similar to the support members of the shell.

20. The seat cushion of claim 19, wherein the backfill sections are comprised of closed-cell foam having a density on the order of 2 lbs. per cubic foot.

* * * * *

UNITED STATES PATENT AND TRADEMARK OFFICE

CERTIFICATE OF CORRECTION

PATENT NO. : 5,286,089

DATED : February 15, 1994

INVENTOR(S) : S. L. Goldman

It is certified that error appears in the above-indentified patent and that said Letters Patent is hereby corrected as shown below:

| COLUMN | LINE | |
|---|---|---|
| 4 | 55 | "7/8L" should read --1/3L-- |
| 5 | 48 | "ppreferalby" should read --preferably-- |
| 6 (Claim 2, | 59 Line 4) | "7/8L" should read --1/3L-- |
| 7 (Claim 11, | 21 Line 3) | after "cushion" insert --being-- |

Signed and Sealed this

Fifth Day of July, 1994

*Attest:*

Bruce Lehman

BRUCE LEHMAN

*Attesting Officer*

*Commissioner of Patents and Trademarks*